US005427360A

United States Patent [19]

Erny

[11] Patent Number: 5,427,360

[45] Date of Patent: Jun. 27, 1995

[54] REFRACTORY BRICK DESIGN FOR OPEN END OF REFRACTORY LINED VESSEL

[75] Inventor: Edward L. Erny, Bethel Park, Pa.

[73] Assignee: Indresco Inc., Dallas, Tex.

[21] Appl. No.: 126,256

[22] Filed: Sep. 24, 1993

[51] Int. Cl.[6] ..... C21C 5/44

[52] U.S. Cl. ..... 266/283; 266/275; 266/44

[58] Field of Search ..... 266/280, 283, 286, 275, 266/44

[56] References Cited

U.S. PATENT DOCUMENTS

| | | | |
|---|---|---|---|
| 1,410,729 | 3/1922 | Balz | 266/283 |
| 3,203,688 | 5/1961 | Sieckman et al. | 266/283 |
| 3,422,857 | 6/1967 | Napora | 266/283 |
| 3,800,014 | 3/1974 | Brichard | 266/283 |
| 4,079,184 | 3/1978 | Bahout et al. | 266/280 |
| 4,155,703 | 5/1979 | Mantey et al. | 266/280 |
| 4,900,249 | 2/1990 | McCollum et al. | 266/283 |
| 4,989,843 | 5/1991 | Dittrich et al. | 266/283 |

FOREIGN PATENT DOCUMENTS

| | | | |
|---|---|---|---|
| 42-26363 | 12/1967 | Japan | 266/283 |
| 7100228 | 7/1971 | Netherlands . | |

*Primary Examiner*—Scott Kastler
*Attorney, Agent, or Firm*—John L. Sigalos

[57] ABSTRACT

Method and geometrical arrangement of refractories within a high temperature vessel. A protuberance near the periphery of the vessel opening is formed on an inner surface and a ring of trapezoidally-shaped refractory brick is positioned such that a sloping surface of each of the trapezoidally-shaped brick is preferably initially in contact with an adjacent surface of the protuberance. When the interior of the vessel is heated and the brick expand, they tend to ride upwardly, with the sloping surfaces urging the brick inwardly thereby increasing lateral friction therebetween, thereby holding them in place and preventing them from moving even when the vessel is tilted or turned upside down.

19 Claims, 1 Drawing Sheet

REFRACTORY BRICK DESIGN FOR OPEN END OF REFRACTORY LINED VESSEL

This invention relates to improved refractory configurations for surrounding the openings in refractory lined vessels for very high temperature molten materials such as iron or steel.

BACKGROUND OF THE INVENTION

High temperature vessels of the type for which the present invention is particularly efficacious include ladles for molten metal, tilting furnaces, rotary kilns or other similar vessels lined with a refractory material and having a curved interior cross-section, illustrative of which is that disclosed in U.S. Pat. No. 4,989,843 granted to William E. Dietrich et al on Feb. 5, 1991. Because of the extremely high operating temperature of such vessels, a number of problems have arisen in utilizing the proposals of the prior art. Thus, for example, refractory materials are subject to thermal expansion and contraction, thermal shock, and wear abrasion, all of which may be exacerbated by molten material impurities such as slag.

In addition to the foregoing, and in part due to considerations relating to the extremes of thermal expansion and contraction resulting from the extreme temperature excursions, there has been a tendency for refractory bricks or the like to loosen, fracture or dislodge from their installed positions and either drop into the contents of the vessel or to fall outwardly therefrom when the vessel is tilted or inverted to empty its contents.

High temperature vessels of the type contemplated hereby and referred to above, typically include a metal outer shell, an inner lining composed of a plurality of aligned or superimposed courses of refractory brick and an opening at one end of the vessel. Unless provision is made at the open end of the vessel for retaining the refractory bricks securely in place, forces exerted on the refractory bricks in a direction toward the open end of the vessel may cause one or more of the courses of refractory bricks to fall out at the open end.

Proposals have heretofor been made for retaining refractory linings in place, but all of these prior proposals have had disadvantages. As referred to in the foregoing U.S. Pat. No. 4,989,843, one such prior art retaining structure was in the form of steel angle iron having one flange attached to the inner surface of the outer shell of the ladle adjacent the open end and another flange unenclosed by refractory material extending from its junction with the one flange at the open end of the ladle. This other flange extended radially inward with respect to the ladle interior a distance substantially the same as that to which the refractory material extended, and there was a layer of refractory ramming material sandwiched between the nearest course of refractory brick and one surface of the inwardly extending flange of the steel angle iron. When the ladle was wholly or substantially inverted, the aligned courses of refractory brick were supported by the inwardly extending flange of the steel angle iron, thus preventing the refractory material from falling out of the inverted ladle. However, the foregoing and other types of prior art retaining structures exhibited problems when subjected to preheating or extreme temperature excursions. As is known to those skilled in the art, a preheater is typically employed to heat the refractory material to a temperature near that to which it will be subjected when encountering molten materials so as to reduce the danger of rupture or failure due to thermal shock. Typically, hot gases are directed from the preheater to the open end of the vessel into its interior. Hot exhaust gases escaping from the interior during the preheating operation encounter the prior art retaining structures, and because a portion of the metal thereof typically was exposed to such gases and was not entirely enclosed by refractory, a portion was excessively heated by the hot exhaust gases, eventually resulting in structure deformation or failure. In such event, the effectiveness of such retaining structures was substantially reduced or eliminated.

As further described in the above U.S. Patent, attempts to solve the foregoing retaining structure problem resulted in a different orientation of iron materials utilized in the retaining structure so as to make it practical to entirely cover it with a layer of refractory ramming material reinforced with other elements. However, such refractory ramming material was thus exposed to wear, thereby requiring more frequent maintenance.

Still other problems were inherent in prior art proposals. Thus, for example, in the heretofore described prior art proposals, problems were encountered when it became necessary to replace worn refractory bricks or courses of refractory materials. For this purpose a jack hammer was primarily employed. Because of the vessel geometries and the attendant difficulties in effective positioning and control of the jack hammer, damage often resulted to the retaining structures thereby requiring their replacement.

The above mentioned U.S. Pat. No. 4,989,843 sets forth proposals for ameliorating the problems inherent in the preexisting prior art. According to the proposals of that patent, a rounded protrusion was provided near the inner circumference of the vessel opening, and a course of refractory brick was installed in mating engagement therewith. Each of the refractory brick in such course was provided with a rounded recess that upon installation was in mating engagement with the circumferential protrusion, thus providing for the locking of each of the refractory brick in such circumferential course to the circumferential protrusion and consequently through it to the main body of the vessel exterior. However, it has been found in practice that due to the extreme temperature variations and consequent expansions and contractions, there has been a tendency for such special notched refractory brick to fracture, thereby degrading or destroying the effectiveness of the circumferential protrusion from retaining such brick in their appointed locations. Accordingly, there has continued to be a need for an improved construction which provides for secure retention of such refractories in their appointed positions while at the same time avoiding the foregoing problems of the prior art proposals.

BRIEF SUMMARY OF THE INVENTION

The principles of the invention thereof overcome the deficiencies of the prior art by eliminating the foregoing notch while advantageously exploiting the thermal expansion of the entire refractory lining so as to increase frictional forces between adjacent brick to prevent their dislodgment. This is accomplished by providing a refractory brick of trapezoidal geometry with the upper and lower surfaces being parallel but with the vertical tending surfaces being non-parallel. When installed, the rear surface is in a sloping relationship to the adjacent vessel wall while a portion thereof may be in contact with the aforementioned circumferential protrusion. Thus, any upward movement of the refractory brick ocassioned by thermal expansion causes such brick to move sightly inwardly as its tapered surface rides up against such protrusion. When this occurs, because such refractory brick are disposed circumferentially, as they move inwardly toward the center of the vessel, lateral pressures therebetween are increased, thereby increasing frictional engagement to retain such brick in their desired positions. In addition, because there are no notches or other discrete physical limitations imposed by the geometrical interrelationships, increases are gradual, distributed over substantial surface areas, and are partially absorbed by cooperatively acting mortar or grout, thereby dramatically reducing susceptibility to fracture or other failure.

OBJECTS AND FEATURES OF THE INVENTION

It is one general object of this invention to improve high temperature refractory lined vessels.

It is another object of the invention to reduce failures and increase life of such vessels.

It is still another object of the invention to simplify repairs to such vessels.

It is yet another object of the invention to facilitate the installation of refractory materials in such vessels.

It is still one further object of the invention to reduce initial costs and maintenance of such vessels.

Accordingly, and in accordance with one feature of the invention, one non-right angular surface of a refractory brick is disposed in a wedge like relationship with a wall of a containment vessel and a protrusion thereby facilitating thermal expansion of the refractory lining.

It is still another feature of the invention to advantageously employ thermal expansion by correspondingly moving refractory bricks inwardly thereby avoiding discrete limitations to thermal expansion and movement.

It is still one further feature of the invention to advantageously employ the aforementioned thermal expansion inward movement by correspondingly increasing lateral frictional forces between adjacent brick thereby increasing the forces retaining the brick in the desired positions.

These and other objects and features of the invention will be apparent from the following detailed description by way of example, with reference to the drawing.

DETAILED DESCRIPTION OF THE INVENTION

Figure 1:
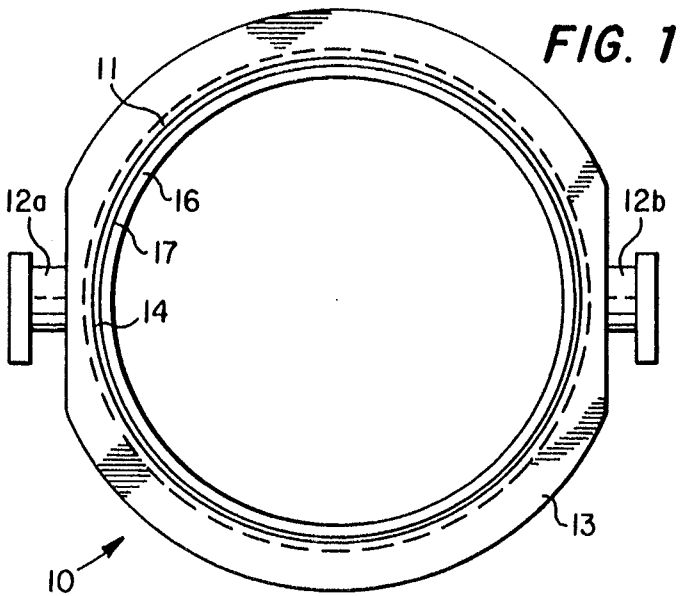
FIG. 1 is a top view of a typical high temperature refractory ladle.

Now turning to the drawing, and more particularly FIG. 1 thereof, it will be seen to depict a high temperature ladle generally shown at 10. Attached to the sides 11 of the ladle are a pair of conventional trunnions 12*a* and 12*b* provided for manipulating the ladle. Also included in the embodiment of FIG. 1 is a conventional outwardly projecting optional lip 13 which may or may not be provided, depending upon the use to which the ladle is to be principally put.

As is known to those skilled in the art, the exterior shell of a ladle such as that illustrated in FIG. 1 is usually made of iron or steel of thickness adequate to support the weight of the refractory lining and the material which is to fill the vessel. The thickness will vary, depending upon the size of the vessel and the material for which it is intended to be used, and such is conventional and well known. Accordingly, the thickness of the sides 11 and the dimensions of the hereinafter described wall, support wall, support and members are not critical except to the extent described below. Accordingly, it should be understood that the illustrations herein are not necessarily to scale but are merely provided to illustrate the invention and preferred embodiment hereof. Moreover, it should be noted at this point that for purposes of clarity, FIG. 1 illustrates the condition of the vessel before refractory materials are installed and therefore does not show all of the elements of FIGS. 2 and 3.

Figure 2:
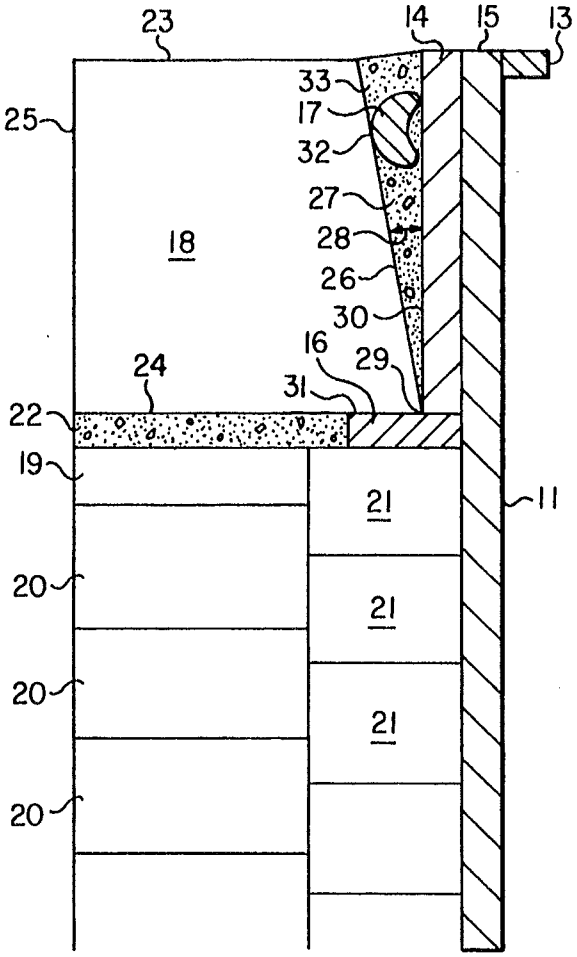
FIG. 2 is a partial section side view showing details of a preferred embodiment in accordance with the principles of the invention.
Figure 3:
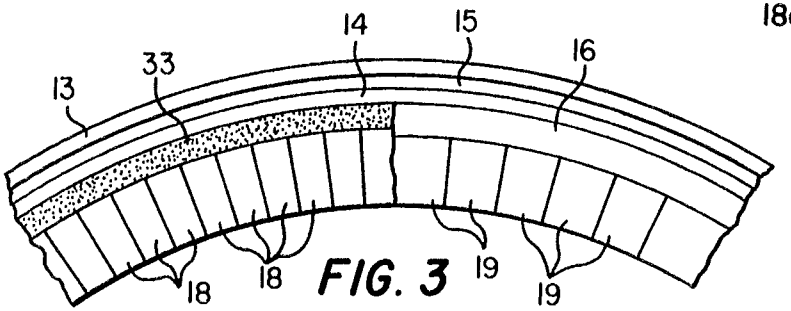
FIG. 3 is a partial cut away view depicting a top layer of refractory bricks positioned in accordance with the invention.

In addition to the foregoing, and as more particularly illustrated in FIGS. 2 and 3, FIG. 1 shows an additional partial wall member 14 extending from adjacent the top 15 of the ladle 10 downwardly to a portion of the upper part of inwardly-projecting annular support 16. The partial wall member 14 and annular support 16 strengthen the vessel around its opening and provide support for the special trapezoidally-shaped refractory brick that are emplaced according to the principles hereof. In addition, there is provided an annular member 17 which may be either a part of wall member 14 or securely fastened thereto as by welding.

As mentioned above, FIG. 2 is a partial sectional view through the side of vessel 10 and illustrates the elements of FIG. 1 in greater detail. In addition, it illustrates the positioning and shapes of refractory brick and mortar.

In practicing the principles hereof, the lower refractory bricks, e.g., bricks 19, 20 and 21 are conventional. As will be recognized by those skilled in the art, brick 21 are the customary safety refractories, while brick 19 and 20 illustrate the customary working refractories. They may be made of any of the conventional materials commonly employed in the high temperature arts. Trapezoidally-shaped refractory 18, on the other hand is unconventional in shape. Although not essential to the practice of the invention, the material from which it is made should not only be relatively slag and abrasion resistant, but additionally to have high strength so as to satisfactorily withstand lateral stresses arising from expansion when subjected to elevated temperatures. The materials found to be most preferred are conventional alumina and basic brick and precast compositions used in metallurgical ladles.

Again viewing FIG. 2, it will be seen preferably to include a layer 22 of refractory mortar or grout which may be any of a variety of conventional materials well known in the art. It is provided to fill in the space that otherwise would exist inwardly of support 16, above refractory 19 and below refractory 18. In some instances, no grout need be used.

As previously mentioned, special refractory brick 18 is trapezoidal in shape as shown in FIG. 2. Thus, while its upper and lower surfaces 23 and 24 are parallel, its outwardly-facing surface 26 is not parallel to this inwardly-facing surface 25, thus forming a tapered slot 27 characterized by acute angle 28. The degree of taper as illustrated by acute angle 28 is not critical to the practice of the invention. While the selected size of the angle will depend to some extent upon the related geometries of the vessel, it has been found that an angle lying in the range of from about 10° to 45° has been satisfactory. Irrespective of the selected angle, the tapered slot 27 is filled with refractory mortar or grout 33 so as to eliminate any void that otherwise could cause problems in use.

Further inspection of FIG. 2 will reveal that outer-facing surface 26, at its lower extremity abuts the intersection 29 of inner surface 30 of partial wall member 14 and upper surface 31 of annular support 16. It need not abut surface 31. In addition, surface 26 contacts the adjacent curved surface 32 of annular protrusion 17, but need not do so. These points of contact are important in defining the position of refractory brick 18.

As mentioned above, the lower refractories are conventionally installed, after which layer of refractory mortar or grout 22 is prepared. Refractories 18 are then installed in a ring surrounding the opening of the vessel as illustrated in FIG. 3.

Figure 4:
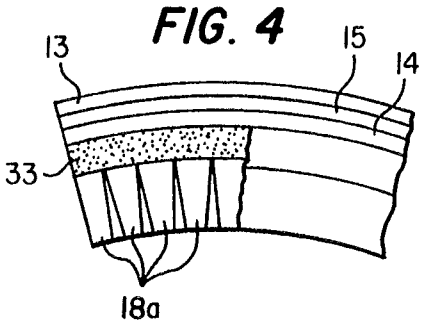
FIG. 4 is a view showing wedge-shaped brick according to an alternate embodiment of the invention.

Now turning to FIG. 3, it will be seen to depict a part of the upper end of vessel 10, cut away to show only a portion of the trapezoidally-shaped refractory brick 18 that overlie conventional refractories 19. FIG. 3 illustrates the side-by-side relationship of the refractories. As illustrated, they are of substantially uniform thickness, and the slight non-uniformity in spacing therebetween from front to back (due to the circumferential geometry of the array) is compensated for by a very thin layer of mortar or grout therebetween that is applied in slurry form as the brick are put in place. Brick of different thicknesses can be used. In common installations a combination of arch, straight, and wedge brick can be used. Brick 18 as seen from the top (FIG. 3) are arch shaped as illustrated by brick 18*a* in FIG. 4, with the thickness decreasing slightly toward the center line of the vessel. Such change of thickness is exaggerated in FIG. 4 in order that it may be illustrated more clearly.

When a high temperature vessel according to the invention is put into use, it ordinarily is pre-heated to a temperature near that of the material selected for introduction. Because of the extremely high temperature change, the refractory materials expand significantly. The expansion of refractories 18, 19, and 20 is advantageously employed to increase the forces holding them in place. Thus, as temperature rises and brick 18 tend to expand upwardly, their outwardly facing surfaces 26 tend correspondingly to ride upwardly; and because of the inclination of such surfaces, the forces between surfaces 26 and annular protrusion 17 urge brick inwardly toward the center of the ladle opening. This in turn squeezes the forward positions of the brick together, increasing friction therebetween, and correspondingly increasing the forces holding them in place. Accordingly, changes due to thermal expansion are turned to advantage and have been found to reliably and dependably hold the brick (such as brick 18) installed around the periphery of the ladle opening in their installed locations even when the ladle is tilted for pouring or inverted for emptying.

It will now be evident to those skilled in the art that there has been described herein an improved high temperature vessel which provides enhanced reliability, service life and ease of maintenance.

Although the invention hereof has been described by way of example of a preferred embodiment, it will be evident that other adaptations and modifications can be employed without departing from the spirit and scope thereof. For example, a series of annularly disposed protuberances could be employed rather than a continuous ring as illustrated.

The terms and expressions employed herein have been used as terms of description and not of limitation; and thus, there is no intent of excluding equivalents, but on the contrary it is intended to cover any and all equivalents that may be employed without departing from the spirit and scope of the invention.

What is claimed is:

1. A vessel for very high temperature materials comprising:

a. A shell having a bottom and sides, an exterior surface, an interior surface, and an opening having an upper terminus for receiving materials thereinto and for exiting high temperature materials therefrom, said opening having a partially curved profile;

b. A protuberance extending inwardly from said interior surface adjacent to and at a first distance below said opening, said protuberance further extending laterally and generally parallel to said opening adjacent a majority of said opening;

c. A layer of refractory material lining that part of said interior surface including said bottom and extending upwardly to a location near but beneath said protuberance a second distance; and d. Another layer of refractory material lining a part of said interior surface beginning at said second distance and ending adjacent said opening, said another layer comprising a plurality of trapezoidally shaped refractory brick having parallel top and bottom surfaces.

2. A vessel according to claim 1 in which said opening is located at the top of said vessel.

3. A vessel according to claim 1 in which said first distance is uniform.

4. A vessel according to claim 1 in which each of said trapezoidally shaped refractory brick contains a non-parallel surface which is non parallel to each of the other surfaces of said trapezoidally shaped brick and in which said non-parallel surface of each of said trapezoidally-shaped refractory brick is in direct contact with an adjacent surface of said protuberance.

5. A vessel according to claim 1 in which said plurality of trapezoidally shaped refractory brick are disposed in side-by-side engagement ringing said opening of said vessel.

6. A vessel according to claim 1 in which each of said trapezoidally-shaped refractory brick is a straight brick unvarying in thickness throughout.

7. A vessel according to claim 1 in which all of said trapezoidally-shaped refractory brick are of the same unvarying thickness throughout.

8. A vessel according to claim 1 in which one of said trapezoidally-shaped refractory brick is a straight, arch or wedge brick.

9. A vessel according to claim 1 in which a plurality of said trapezoidally-shaped refractory brick are of varying thickness.

10. A vessel according to claim 1 in which all of said trapezoidally-shaped refractory brick are of varying thickness.

11. A vessel according to claim 1 in which said protuberance is divided into segments.

12. A vessel according to claim 2 in which said first predetermined distance is uniform.

13. A method of lining a vessel for high temperature materials comprising:

a. Providing an exterior shell for said vessel having a bottom and sides, an exterior surface, an interior surface, and an opening having an upper terminus for receiving materials thereinto and for exiting high temperature fluids therefrom, said opening having a partially curved profile;

b. Providing a protuberance extending inwardly from said surface adjacent and at a first distance below said opening and extending said protuberance laterally and generally parallel to said opening adjacent a majority of said opening;

c. Lining with refractory material a part of said interior surface including the bottom and sides of said interior surface up to a location near but beneath said protuberance a second distance; and d. Lining with trapezoidally-shaped refractory brick having parallel top and bottom surfaces that part of said interior surface beginning at said second distance and ending adjacent said opening.

14. A method according to claim 13 including a step of forming on each of said trapezoidally shaped brick a surface non-parallel to all other surfaces of said trapezoidally-shaped bricks and positioning said trapezoidally-shaped brick adjacent said opening with said non-parallel surfaces in contact with an adjoining surface of said protuberance.

15. A method according to claim 13 including a step of installing said trapezoidally-shaped brick in side-by-side relationship ringing said opening of said vessel.

16. A vessel for very high temperature liquids comprising:

a. A shell having a bottom and sides, an exterior surface, a principal interior surface, and an opening having an upper terminus for receiving materials thereinto and for exiting high temperature fluids therefrom, said opening having a partially curved profile and a central axis therethrough;

b. A first part of said principal interior surface extending partially inwardly from said principal interior surface adjacent to but a first distance below said opening, said first part of said principal interior surface further extending laterally and generally parallel to said opening adjacent a majority of said opening;

c. A first layer of refractory material lining said first part of said principal interior surface; and d. Means responsive to increasing temperature of said first layer of refractory material for correspondingly urging said first layer of refractory material toward said axis.

17. A vessel according to claim 16 wherein said means for urging said first layer toward said axis includes said first part of said principal interior surface.

18. A vessel according to claim 16 wherein said layer of refractory material comprises a plurality of trapezoidally shaped refractory bricks.

19. A vessel according to claim 18 wherein said means for correspondingly urging said first layer toward said axis is further responsive to increasing temperature of said refractory material for urging together said plurality of trapezoidally shaped bricks thereby to increase lateral friction therebetween.

* * * * *